United States Patent [19]

Watkins

[11] 4,118,065

[45] Oct. 3, 1978

[54] FOLDING PATIO CHAIR

[76] Inventor: Mervyn M. Watkins, 30241 Via Borica, Rancho Palos Verdes, Calif. 90274

[21] Appl. No.: 828,483

[22] Filed: Aug. 29, 1977

[51] Int. Cl.[2] ..... A47C 4/44

[52] U.S. Cl. ..... 297/45; 280/42; 297/DIG. 4

[58] Field of Search ..... 297/45, 44, 42, 58, 297/55, 46, DIG. 4; 280/42

[56] References Cited

U.S. PATENT DOCUMENTS

| | | | |
|---|---|---|---|
| 2,606,593 | 8/1952 | Bearskens | 297/DIG. 4 |
| 2,616,718 | 11/1952 | Heideman | 297/46 X |
| 2,632,654 | 3/1953 | Cornish | 297/44 X |
| 2,757,715 | 8/1956 | Hendrickson | 297/58 |
| 3,995,882 | 12/1976 | Watkins | 280/42 |
| 4,014,591 | 3/1977 | Gittings | 297/55 |
| 4,030,769 | 6/1977 | Peng et al. | 297/45 X |

FOREIGN PATENT DOCUMENTS

| | | | |
|---|---|---|---|
| 707,326 | 4/1954 | United Kingdom | 297/58 |

*Primary Examiner*—Francis K. Zugel
*Attorney, Agent, or Firm*—John Holtrichter, Jr.

[57] ABSTRACT

An improved folding chair structure having a pair of parallel frame tubes and a pair of parallel support tubes that are laterally foldable, each pair held in respective parallel relationships by front and rear x-braces, and also included is a pair of parallel seat tubes the rear end of which being pivotally attached to a fixed intermediate point along an associated support tube, the structure further including a separate guide movably mounted along intermediate portions of each of the frame tubes, the guides being pivotally attached to the upper ends of associated brace members of both the front and rear x-braces and also to an associated one of the seat tubes whereby the collapsing of the structure by moving the parallel frame, support and seat tubes together causes the guides to move upwardly while the angle between the planes defined by the respective frame and support tubes and between the planes defined by the respective support and seat tubes, decreases.

16 Claims, 13 Drawing Figures

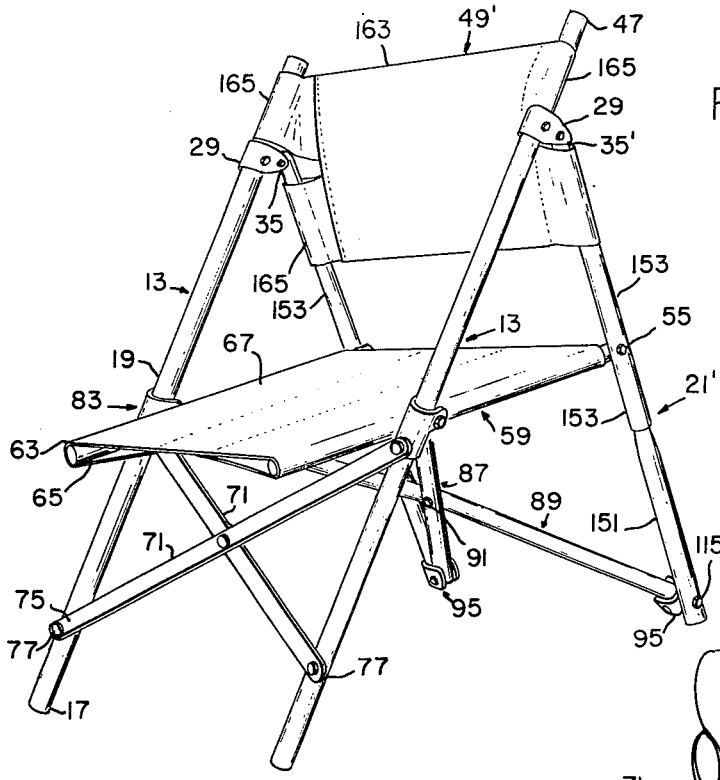
Fig. 8.
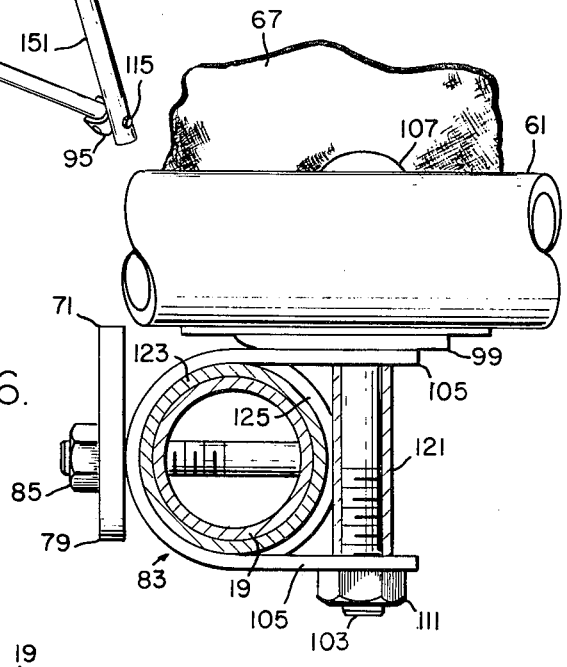
Fig. 6.
Fig. 5.
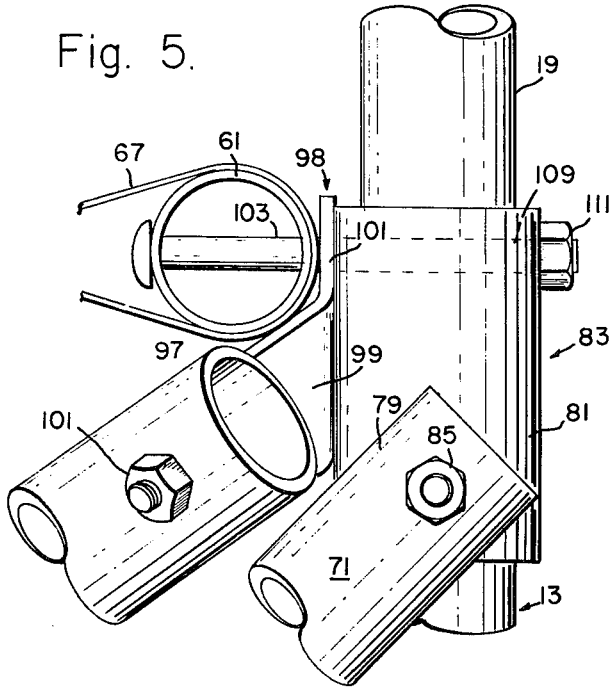
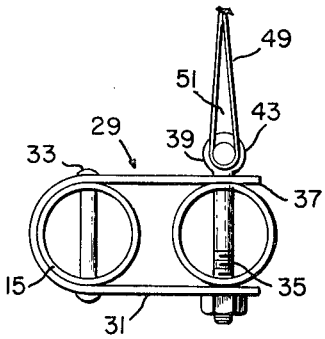
Fig. 4.

Fig. 13.
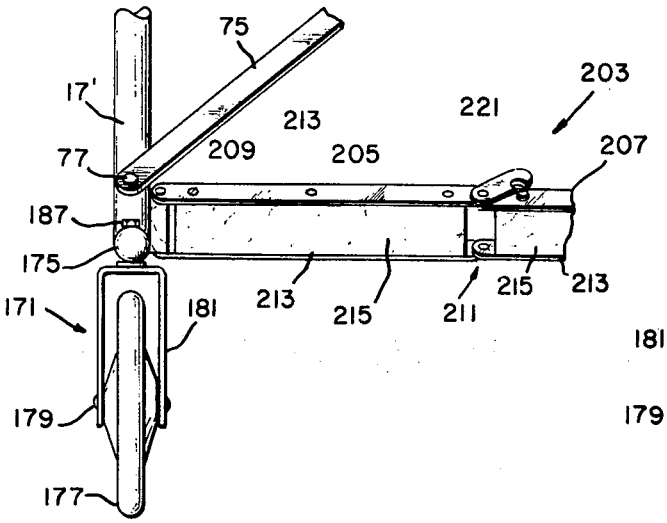
Fig. 12.
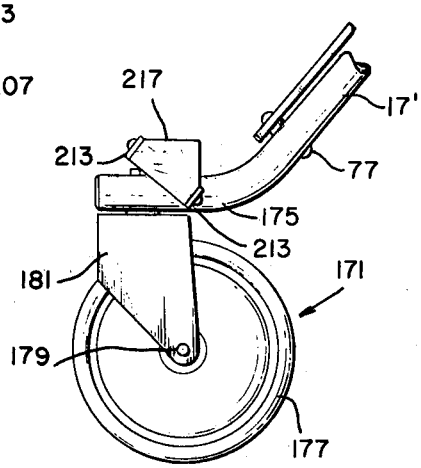
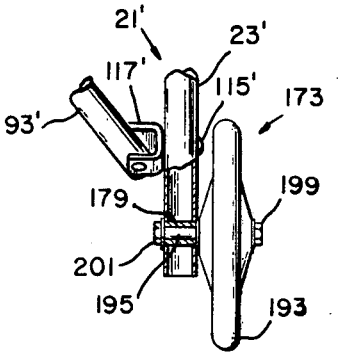
Fig. 11.
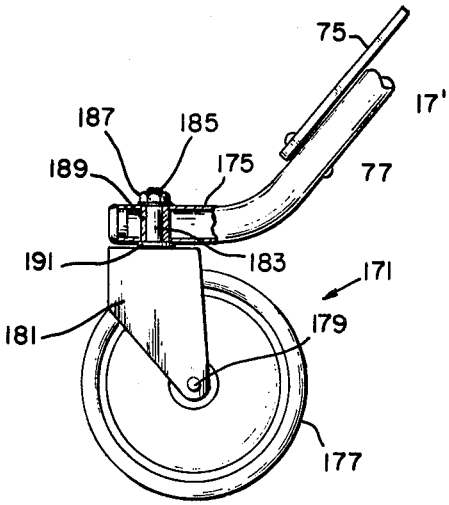
Fig. 10.

FOLDING PATIO CHAIR

BACKGROUND OF THE INVENTION

The background of the invention will be set forth in two parts.

1. Field of the Invention

The invention relates to folding structures and more particularly to folding chairs.

2. Description of the Prior Art

Over the years, many folding chairs have been developed, some having solid seat and back members, while others utilizing fabric for less formal and more comfortable support.

Most folding chairs only allow folding along one dimension so that even when in its folded configuration, the structure is still rather bulky and, therefore, not well adapted to be moved or transported in a vehicle.

There have; however, been developed folding structures adapted to support a person in a sitting position which may be folded along more than one dimension, but these generally are not stable structures and have a tendency to collapse or tip over unless care is exercised in their use. Typically, these chairs use a sling seat which is not considered good for posture.

On the other hand, the invention to be described hwerein has been designed with unique and advantageous features which obviate the unstable qualities of the prior art chairs while remaining relatively simple to use and construct, and maintains the preferred firm seat and back characteristics of conventional chairs.

SUMMARY OF THE INVENTION

In view of the foregoing factors and conditions, it is a primary object of the present invention to provide an improved folding patio chair.

Another object of the present invention is to provide a light-weight, stable folding patio chair that utilizes a novel sliding mechanism pivotally attached to other movable members of the chair to allow the folding thereof simultaneously along several dimensions.

Still another object of the present invention is to provide a folding patio chair having comfortable fabric seat and back supports while exhibiting the stability and durability of a well-built non-folding chair.

Yet another object of the present invention is to provide a folding patio chair which incorporates a unique telescoping support structure that enhances the ease of moving the structure from its unfolded-to-folded configuration and helps achieve correct proportional design.

In accordance with an embodiment of the present invention, a folding patio chair suitable for supporting a person in a sitting position is provided having a pair of parallel elongated frame tubes each having upper, lower and intermediate portions, the frame tubes defining a first plane therebetween. Also provided is a pair of parallel elongated rear support tubes each having upper, lower and intermediate portions, the upper portions of each of the support tubes being pivotally attached at a fixed position along the upper portion of a different one of the frame tubes, the support tubes defining a second plane therebetween intersecting the first plane along a line perpendicular to the longitudinal axes of the frame and support tubes. A pair of parallel elongated seat tubes having front, rear and intermediate portions are also utilized, the rear portions of each of the seat tubes being pivotally attached at a fixed position along the intermediate portion of a different one of the support tubes, the seat tubes defining a third plane therebetween intersecting the first plane along a movable line and intersecting the second plane along a line perpendicular to the longitudinal axis of the support tubes. A rear x-brace is provided having a pair of pivotally interconnected rear brace members defining a fourth plane therebetween, the rear brace members being foldable in the fourth plane and the lower ends of each of the brace members, being pivotally attached to a different one of the support tubes at the lower portions thereof. There is further provided a front x-brace having a pair of pivotally interconnected front brace members defining a fifth plane therebetween, the front brace members being foldable in the fifth plane and the lower end of each of which being pivotally attached to a different one of the frame tubes along the lower portions thereof. The folding chair according to the invention still further includes an individual guide movably mounted along the intermediate portion of each of the frame tubes, each of the guides being pivotally attached to an associated one of the intermediate portion of the seat tube, to an upper end of one of the rear brace members, and to an upper end of one of the front brace members for simultaneously causing an upward movement of the movable line in the first plane, a lessening of the angle between the first and second planes, and a lessening of the distance between the frame tubes and between the seat tubes when the folding patio chair is moved from its open to closed configuration.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing, in which like reference characters refer to like elements in the several views.

BRIEF DESCRIPTION OF THE DRAWINGS

FIG. 4 is a sectional view of the portion of the patio chair shown in FIG. 3, taken along line 4—4;

FIG. 5 is an enlarged front elevational view of the moving folding structure of the chair shown in FIG. 1;

FIG. 6 is a sectional top plan view of a portion of the structure of FIG. 5;

FIG. 8 is a perspective view of a folding patio chair constructed in accordance with another embodiment of the present invention;

FIGS. 10 and 11 are respectively side and front elevational views of front and rear casters which may be attached to a lower curved portion of each frame tube and to the lower portions of each rear support tube in accordance with still another embodiment of the present invention; and FIGS. 12 and 13 are side and front elevational views of the front caster arrangements as shown in FIG. 10, but also including a collapsable foot rest in accordance with yet a further embodiment of the invention.

Figure 1:
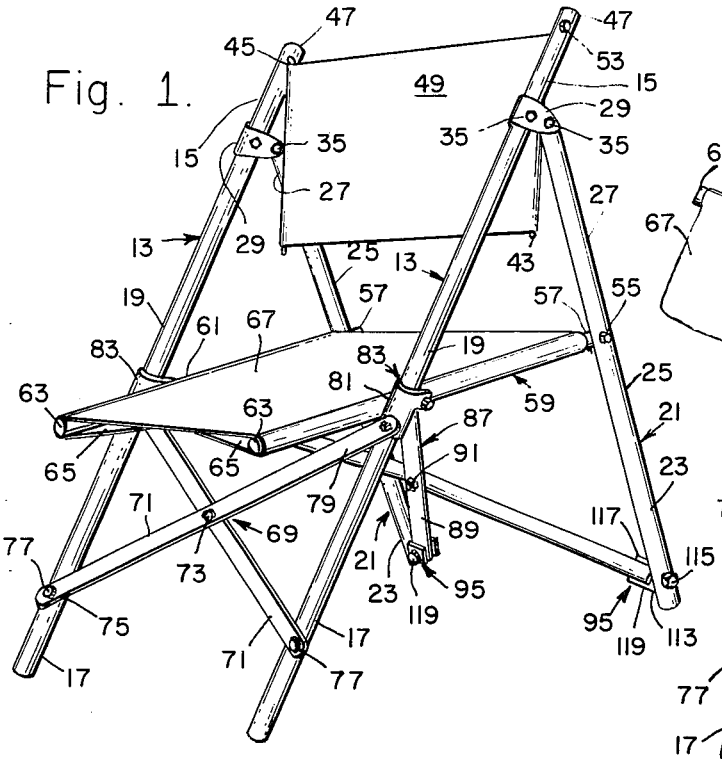
FIG. 1 is a perspective view of a folding patio chair constructed in accordance with the present invention.
Figure 2:
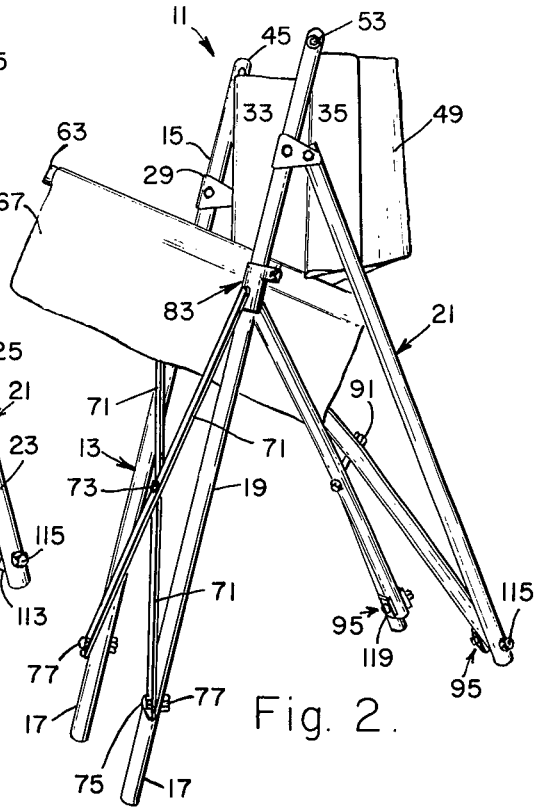
FIG. 2 is a perspective view of the chair of FIG. 1 in a partially folded configuration.

DESCRIPTION OF THE PREFERRED EMBODIMENT:

Referring now to the drawings, and more particularly to FIGS. 1 and 2, there is shown a folding patio chair 11 adapted to support a person in a sitting position. The chair 11 includes a pair of parallel elongated frame tubes 13, each having an upper portion 15, a lower portion 17 and an intermediate portion 19.

Figure 3:
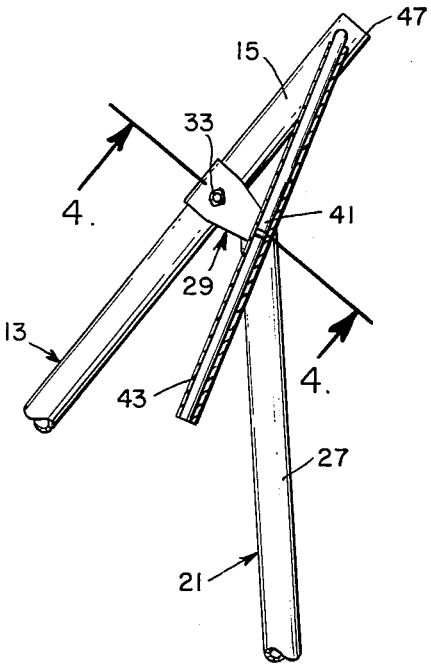
FIG. 3 is an enlarged elevational view of the folding patio chair taken along line 3—3 of FIG. 1.

A pair of parallel elongated rear support tubes 21, having lower portions 23 and intermediate portions 25, are respectively attached at their upper portions 27 to the upper portions 15 of the frame tubes 15 by suitable pivot mechanisms 29. As best seen in FIG. 3, the mechanism 29 comprises a U-shaped bracket 31 fixedly attached to the upper portion 15 of the frame tubes 13 by a nut and bolt or rivet-type fastener 33 extending through suitable holes in the bracket and tube. It also comprises a bolt 35 extending through suitable holes adjacent the open end 37 of the bracket 29 and through holes in the upper portion 27 of the support tubes 21 enclosed by the bracket 29. In this embodiment, the bolt 35 may include a closed, or partially closed, eye portion 39 adapted to hold therein an intermediate portion 41 of a back-support anchor rod 43, the upper end 45 of which is anchored in suitable holes in the frame tube 13 adjacent its upper end 47. As can be seen in FIGS. 1–4, the back support also includes a piece of fabric 49 having side openings 51 through which the rods 43 extend to hold the fabric in place, while the upper ends of the rods 43 are held in place by suitable press-fit caps 53.

Pivotally anchored to the intermediate portions 25 of the support tubes 21 by suitable nut and bolt assemblies 55 are the rear ends 57 of a pair of elongated parallel seat tubes 59, each having an intermediate portion 61 and a forward portion 63. The seat tubes 59 extend within appropriate elongated openings 65 along each side of a fabric seat panel 67 and, therefore, directly bear the majority of the weight of a person seated in the chair 11 when in its unfolded or open position.

The frame tubes 13 are held in parallel relationship by a front x-brace assembly 69 comprising front brace bar members pivotally interconnected by a pivot 73, the lower ends 75 of which brace members are pivotally anchored by any suitable nut-bolt or rivet arrangement 77 to respective lower portions 17 of the tubes 13, while the upper ends 79 of the members 71 are respectively pivotally attached to a front portion 81 of movable guides 83 by pivot pin assemblies 85.

The folding chair 11 is also provided with a rear x-brace assembly 87, the assembly including a pair of tubular rear brace members 89 pivotally interconnected by a pivot pin 91 which may be a nut and bolt or pivot assembly. The lower ends 93 of the members 90 are each pivotally attached by means of associated two-axis pivot assemblies 95 to the lower portions 23 of the support tubes 21, while the forward ends 97 of the rear brace members 89 are pivotally attached to respective twisted and generally L-shaped brackets 99 of two-axes pivot assemblies 98 by bolt/nut arrangements 101, best seen in FIGS. 5 and 6. The brackets 99 have an upturned lip portion 101 with an aperture therein through which passes an elongated bolt 103. The bolts 103 extend through appropriate holes in the intermediate portions 61 of the associated seat tubes 59 and also through holes in opposite wing portions 105 of the guides 83. Each of the bolts 103 includes a head portion 107 and an opposite threaded portion 109 threadably preferably engaging a suitably threaded lock nut 11. Alternately, the bolt 103 and nut 111 may be replaced by any conventional attachment configuration, such as a rivet, for example, which allows pivotal movement of the seat tubes 59 and brackets 99 relative to the guides 83.

It is important that both the lower pivot assemblies 95 and the upper pivot assemblies 98, defined by the pivot pins 101, 103 and brackets 99, allow pivotal movement along two different axes in order that the chair 11 may be easily moved from one of its extreme configurations to the other, e.g., open-to-closed, and vice versa. The two axes pivotal characteristics of the upper pivot assemblies 98 are provided by pivotally attaching the brackets 99 to the guides 93 along one axis, and by pivotally attaching the upper portions 97 of the brace members 90 to the brackets 99 along a different axis. Likewise, the lower assemblies 95 each comprise a square U-shaped bracket 113 pivotally attached at its center by pin 115 to the lower portion 23 of a support tube 21, and pivotally attached at its parallel arm 117 by pin 119 to the lower portion 93 of the associated brace member 89.

Figure 7:
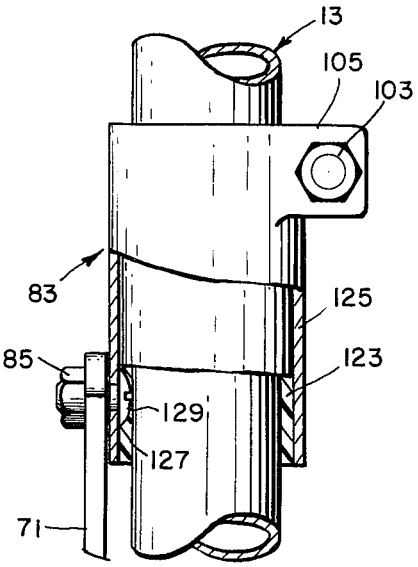
FIG. 7 is a side elevational view of the structure shown in FIG. 5.

In order to prevent the collapse of the wing portions 105 of the guides 93, spacing tubes 121 are disposed therebetween and about the shank of the bolt 103, as shown in FIG. 6. The guides 83 also are preferably provided with tubular liners 123 of suitable plastic or other material disposed within the tubular body portions 125 of the guides. The liners 123 are provided with holes 127 to accomodate the heads 129 of the pivot pin assemblies 85 so that the heads cannot come into contact with the frame tubes 13 (see FIG. 7). Of course, the inner diameter of the liners 123 are suitably dimensioned to allow smooth sliding movement of the guides 83 along the intermediate portions 61 of the frame tubes. Also, to provide ease of manipulation, the rear brace members 89 of the rear x-brace 87 are separated slightly by a tubular spacer 131, through which the pivot pin 91 extends. The members 89 are also preferably bowed away from each other in the area of the pivot in order that the ends of the brace members 89 are generally in a common plane.

The folding patio chair 11 may be most easily moved from its open configuration to its closed configuration by simply grasping with one hand the upper portion 15 of a frame tube 13 and, while grasping with the other hand the forward portion 63 of a seat tube 59 pulling these portions toward each other. The pulling force may be either applied to the appropriate portions on the same or opposite sides of the chair 11. Of course, the opposite directed force should be applied in order to unfold the chair when it is in its closed configuration.

In manipulating the chair 11 from its unfolded to its folded position, it should be understood that the related parallel members move toward each other in their respective common planes while, simultaneously, the angle between the plane defined by the parallel support tubes and the plane defined by the parallel frame tubes is lessened. In the latter configuration, the fram tube, the support tubes, the front x-brace members and the rear x-brace member are all generally parallel to each other in a relatively tight and easily transportable and stowable bundle. Preferably, the various elements of the folding patio chair 11 are fabricated from relatively strong lightweight material, such as stainless steel and- /or suitable alloys of aluminum, for example, in order to provide a strong but lightweight support.

Figure 9:
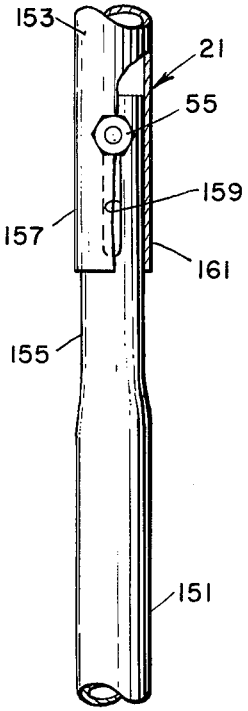
FIG. 9 is an elevational view of a portion of a support tube of the folding chair illustrated in FIG. 8.

Referring now to a presently preferred embodiment 11' of the invention as shown in FIGS. 8 and 9, the support tubes 21' each comprise two telescoping sections 151 and 153, the upper reduced diameter portion 155 of the lower section 151 preferably extending within the lower tubular portion 157 of the upper section 153. In this embodiment, each of the portions 155 include an elongated axial slot 159 through which an associated nut and bolt assembly 55 extends. Also, a sleeve 161 similar to sleeve 123 is disposed between the two telescoping sections in order to reduce friction in the relatively tight, sliding joint. The length and position of the elongated slot 159 is preferably such that the shank portion of the assembly 55 contacts the top of the slot when the chair is completely unfolded and contacts the bottom end of the slot when it is completely folded.

The embodiment also utilizes a simple yet effective comfortable back support 49' comprising back support fabric 163 having suitable elongated side loops 165 through which the upper portions of the frame and support tubes extend.

FIGS. 10 and 11 are included herein to illustrate still another embodiment of the present invention in which front and rear caster assemblies 171 and 173, respectively, are provided to enhance mobility of the folding chair when in its unfolded configuration. In this embodiment, the lower portion 17' of the frame tubes 13' are curved forwardly so that their ends 175 are horizontally oriented. The conventional caster mechanisms 171 include wheels 177 pivotally mounted on axles 179 held in brackets 181. The brackets include a fixed upward vertically extending posts 183 with threaded upper portions 185, each threadably engaged by a nut 187. The post or shaft 183 are rotatably seated in sleeves 189 which may be permanently affixed in appropriate holes in the tube ends 175. For ease of caster movement, a conventional ball bearing race 191 may be positioned about the shaft 183 between each of the brackets 181 and their associated frame tubes.

The rear caster arrangement, illustrated in detail in FIG. 11, includes a wheel 193 mounted on an axle 195 that is supported horizontally by a sleeve 197 brazed into the lower end 23' of each of the rear support tubes 21'. In accordance with this embodiment, each end of the axles 195 are threadably engaged by conventional lock nuts 199 and 201.

Preferably, a folding foot rest mechanism 203 is provided between the bent lower ends 175 of the frame tubes 17', as shown in FIGS. 12 and 13. The foot rest mechanism 203 includes two pivotally interconnected sections 205 and 207, the outer ends of which are pivotally attached by conventional pivots 209 to the frame tube ends 175 in such a way to allow the two sections to move upwardly (dashed outlines 210 in FIG. 12) at their pivotal junction 211 when the chair is moved to its folded configuration. Each foot rest section has a pair of elongated metal strips 213 between which is sandwiched a length of wood 215, for example, having a flat upper surface 217 parallel to the ground (see FIG. 12). The strips 213 are held in place by screws 219 and the two foot rest sections are prevented from moving below the horizontal by a fixed diagonally upwardly extending stop tab 221.

From the foregoing, it should be quite evident that there has herein been described an improved stable and lightweight folding chair structure. It should also be understood that the various materials specified herein are not critical, and any material having suitable characteristics may be utilized. Also, additional spacers and washers and other similarly functioning pivot configurations may be employed within the scope and contemplation of the invention.

What is claimed is:

1. A folding patio chair for supporting a person in a sitting position, comprising:

a pair of parallel elongated frame tubes each having upper, lower and intermediate portions, said frame tubes defining a first plane therebetween;

a pair of parallel elongated rear support tubes each having upper, lower and intermediate portions, said upper portions of each of said support tubes being pivotally attached at a fixed position along said upper portion of a different one of said frame tubes, said support tubes defining a second plane therebetween intersecting said first plane along a line perpendicular to the longitudinal axes of said frame and support tubes;

a pair of parallel elongated seat tubes having front, rear and intermediate portions, said rear portions of each of said seat tubes being pivotally attached at a fixed position along said intermediate portion of a different one of said support tubes, said seat tubes defining a third plane there between intersecting said first plane along a movable line and intersecting said second plane along a line perpendicular to said longitudinal axis of said support tubes;

a rear x-brace having a pair of pivotally interconnected rear brace members defining a fourth plane therebetween, and rear brace members being foldable in said fourth plane, the lower ends of each of said brace members being pivotally attached to a different one of said support tubes at said lower portions thereof;

a front x-brace having a pair of pivotally interconnected front brace members defining a fifth plane therebetween, said front brace members being foldable in said fifth plane and the lower end of each of which members being pivotally attached to a different one of said frame tubes along said lower portions thereof; and folding means including an individual guide movably mounted along said intermediate portion of each of said frame tubes, each of said guides being pivotally attached to an associated one of said intermediate portions of said seat tubes to an upper end of one of said rear brace members, and to an upper end of one of said front brace members for simultaneously causing an upward movement of said movable line in said first plane, a lessening of the angle between said first and second planes, and a lessening of the distance between said frame tubes and between said seat tubes when said folding patio chair is moved from its open to closed configuration.

2. The folding patio chair according to claim 1, wherein a flexible seat fabric is mounted on and between said seat tubes.

3. The folding patio chair according to claim 1, also comprising a pair of back support rods each anchored adjacent to an upper end of an associated one of said frame tubes, and anchored along an intermediate portion thereof at the pivotal junction of said frame and support tubes, and further comprising back support fabric mounted on and between said back support rods.

4. The folding patio chair according to claim 1, also comprising flexible back support material mounted to and disposed between said upper portions of said frame tubes, and further comprising flexible seat material mounted on and disposed between said seat tubes.

5. The folding patio chair according to claim 1, wherein said pivotal attachments between said rear brace members and said support tubes and between said rear brace members and said guides are of the two-axis type.

6. The folding patio chair according to claim 1, wherein said support tubes are each of unitary construction.

7. The folding patio chair according to claim 1, wherein said support tubes each comprise two coaxial telescoping sections, the length of overlap between said sections being greatest when said chair is in said open configuration.

8. The folding patio chair according to claim 7, wherein the lower of said sections includes an elongated, axially-aligned slot, wherein said pivotal attachments between said seat and support tubes includes an elongated horizontally-oriented pivot pin, said pivot pin in said support tubes extending through said slots in associated ones of said lower sections of said support tubes.

9. The folding support patio chair according to claim 8, wherein the upper portion of each of said lower sections of said support tubes slides within the lower portion of each of said upper sections, and further includes a sliding movement-promoting cylinder disposed between said telescoping sections.

10. The folding patio chair according to claim 1, wherein said guides each include a cylindrical body portion having an inner diameter greater than the outer diameter of said frame tubes, and wherein a pivot pin pivotally engaging each of said front brace members extends forwardly from a front face of each of said cylindrical body portions.

11. The folding patio chair according to claim 1, wherein a sliding movement-promoting cylindrical member is disposed between each of said guides and an associated one of said frame tubes.

12. The folding patio chair according to claim 1, also comprising ground wheel structures mounted at the lower extremities of each of said frame and rear support tubes.

13. The folding patio chair according to claim 12, wherein said ground wheel structures associated with said frame tubes are each pivotally mounted about parallel vertical axes.

14. The folding patio chair according to claim 12, further comprising folding foot rest structure mounted between the said lower extremities of said frame tubes.

15. The folding patio chair according to claim 14, wherein said foot rest structure includes a pair of interconnected legs, the outer extremities of which each being pivotally attached to a different one of said frame tubes.

16. The folding patio chair according to claim 15, wherein a stop tab is disposed on one of said legs adjacent said interconnection limiting the pivotal rotation thereat.

* * * * *